US008128427B2

(12) United States Patent
Mochizuki

(10) Patent No.: US 8,128,427 B2
(45) Date of Patent: Mar. 6, 2012

(54) ILLUMINATION UNIT AND WIRE HARNESS EQUIPPED WITH THE ILLUMINATION UNIT

(75) Inventor: Shinji Mochizuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/687,482

(22) Filed: Jan. 14, 2010

(65) Prior Publication Data

US 2010/0210133 A1 Aug. 19, 2010

(30) Foreign Application Priority Data

Feb. 13, 2009 (JP) ..... 2009-031122

(51) Int. Cl.
*H01R 4/24* (2006.01)

(52) U.S. Cl. ..... 439/419

(58) Field of Classification Search ..... 439/419, 439/397, 398; 362/249, 373
See application file for complete search history.

(56) References Cited

U.S. PATENT DOCUMENTS

| | | | | |
|---|---|---|---|---|
| 4,264,117 | A * | 4/1981 | Pritulsky | 439/419 |
| 4,984,999 | A * | 1/1991 | Leake | 439/425 |
| 5,672,000 | A * | 9/1997 | Lin | 362/249.06 |
| 6,328,593 | B1 * | 12/2001 | Chang et al. | 439/419 |
| 6,494,723 | B2 * | 12/2002 | Yamane et al. | 439/76.2 |
| 6,660,935 | B2 * | 12/2003 | Southard et al. | 362/640 |
| 6,929,502 | B2 * | 8/2005 | Miwa | 439/419 |
| 7,114,841 | B2 * | 10/2006 | Aanegola et al. | 362/640 |
| 7,160,140 | B1 * | 1/2007 | Mrakovich et al. | 439/417 |
| 7,210,957 | B2 * | 5/2007 | Mrakovich et al. | 439/404 |
| 7,399,105 | B2 * | 7/2008 | Southard et al. | 362/391 |
| 7,442,070 | B2 * | 10/2008 | Lee | 439/417 |
| 7,520,771 | B2 * | 4/2009 | Nall et al. | 439/417 |
| 2001/0007526 | A1 * | 7/2001 | Ohkohdo et al. | 362/249 |
| 2002/0177371 | A1 * | 11/2002 | Fukuda et al. | 439/701 |
| 2007/0064450 | A1 | 3/2007 | Chiba | |
| 2008/0030981 | A1 * | 2/2008 | Mrakovich et al. | 362/219 |
| 2010/0226140 | A1 * | 9/2010 | Mochizuki | 362/373 |

FOREIGN PATENT DOCUMENTS

| | | | |
|---|---|---|---|
| JP | 2006-310088 | A | 11/2006 |
| JP | 2008-193133 | A | 8/2008 |

* cited by examiner

*Primary Examiner* — Tulsidas C Patel
*Assistant Examiner* — Harshad Patel
(74) *Attorney, Agent, or Firm* — Sughrue Mion, PLLC

(57) ABSTRACT

An illumination unit comprising: a wire; a light emitting element including a terminal; a crimp terminal including an attachment portion to which the terminal of the light emitting element is directly attached, a fastening portion which electrically connects to the wire, and a crimp portion which clips the wire.

8 Claims, 6 Drawing Sheets

ILLUMINATION UNIT AND WIRE HARNESS EQUIPPED WITH THE ILLUMINATION UNIT

REFERENCE TO RELATED APPLICATIONS

The present application claims priority from Japanese Patent Application No. 2009-031122 filed on Feb. 13, 2009, and entire subject matter of which is incorporated herein by reference.

TECHNICAL FIELD

The present invention relates to an illumination unit which is provided with a light emitting diode (LED) and a wire harness which is provided with a plurality of the illumination units.

BRIEF DESCRIPTION OF RELATED ART

Recently, a light emitting element, such as a light emitting diode (LED), is used for an illumination unit of a vehicle lamp. Since LEDs have characteristics such as its small size, its small electricity consumption, or the like, the application of LEDs to a vehicle room lamp which requires a qualified design especially attracts attention.

Examples of related vehicle lamp are described in JP-A-2006-310088, and JP-A-2008-193133. FIG. 7 and FIG. 8 show an example of an illumination unit 100 used for the related vehicle lamp. The illumination unit 100 is provided with a base member 102, a radiator 103, a LED 101 attached to the base member 102, and a pair of crimp-type terminals 104 attached to the base member 102. Each crimp-type terminal 104 fastens a respective wire 124.

The base member 102 is provided with two chases 106 at the center portion thereof. The chases 106 are parallel to each other. Into each of the chases 106, a wire 124 is inserted respectively. The base member 102 is also provided with a stage 105, which projects with a block shape, at a center portion thereof. The stage 105 is positioned between the chases 106.

The radiator 103 is made from a metal which has high heat radiation performance. The radiator 103 has a box portion 107 and a radiator plate 108. The box portion 107 covers the stage 105. The radiator plate 108 extends from the box portion 107 in a longitudinal direction of the wire 124. The radiator 103 is attached to the base member 102 while the box portion 107 covers the stage 105.

The LED 101 is provided with a main body 110 and a pair of lead terminals 111 (see FIG. 8). The main body 110 has a light source 109. Each of the lead terminals extends from the main body 110 in an opposite direction so as to be distant from each other. The LED 101 is attached to the base member 102 while each of the lead terminals 111 overlap the respective box portion 107.

Each of the crimp-type terminals 104 integrally includes a blade 112 and a plate 113. The blade 112 fastens the wire 124 in the chase 106 while the blade 112 is inserted into the chase 106. The plates 113 overlap the box portion 107.

The above described related illumination unit 100 is assembled as follow. First, the wire 124 is inserted into the case 106 of the base member, where the radiator 103 and the LED 101 are attached. Then, the crimp-type terminal 104 is attached to the base member 102 while the plate 113 overlaps the box portion 107 and the blade 112 is inserted into the chase 106. Then, in this related art, the plurality of the illumination units are arranged in the longitudinal direction of the wire 124 so as to form a wire harness which is attached to an inner surface of the vehicle roof panel.

The illumination unit 100 shown in FIGS. 7 and 8 is provided with the radiator 108, which is specialized to radiate heat generated by the LED 101. Therefore, because it is necessary to attach the radiator 108 to the stage 105, the number of work for the assembling of the illumination unit 100 increases. Also, because the stage 105 is necessary for the base member, the size of the base member 102 becomes large.

Also, the LED 101 is connected to the radiator 103 through the lead terminals 111. This structure limits the heat radiation efficiency because a surface area of the lead terminals 111 is limited. Also, this structure less radiates heat to the outside of the device because the radiator 103 is positioned at the center of the illumination unit 100.

SUMMARY

Exemplary embodiments of the present invention addresses the above disadvantages and other disadvantages not described above. The exemplary embodiment of the present invention is an illumination unit which has improved heat radiation efficiency and a wire harness which is provided with a plurality of the illumination units.

An exemplary embodiment of the present invention is an illumination unit including: a wire; a light emitting element including a terminal; a crimp terminal including an attachment portion to which the terminal of the light emitting element is directly attached, a fastening portion which electrically connects to the wire, and a crimp portion which clips the wire.

Preferably, the illumination unit according to the above embodiment includes a housing in which the crimp terminal is fixed, the housing provided with an opening from which the light emitting element is exposed.

Preferably, the opening has a depth deeper than a thickness of the light emitting element.

Preferably, the fastening portion includes a bottom plate and a pair of side plates, each of the side plates standing from a longitudinal side of the bottom plate and opposite to each other with a predetermined interval.

Preferably, the wire is a coated wire which includes a coating and a core wire coated by the coating.

Preferably, the each of the side plates is provided with a blade which cut in the coating of the coated wire and electrically connects to the core wire.

Preferably, the illumination unit according to the above embodiment includes two of the crimp terminals, each of which is parallel to each other.

Preferably, the crimp portion includes a clip piece which clips the wire.

According to the above described embodiment, since the crimp terminal 3 is provided with the attachment portion 40 to which the LED is directly attached, a member specialized for heat radiation is not necessary, heat generated by the LED 1 is transmitted to and radiated from the crimp terminal 3 with high thermal conductivity, the crimp terminal 3 can be minimized, and heat radiation efficiency can be improved.

According to the above described embodiment, since the housing 2 is provided with the opening 21 from which the attachment portion 40 is exposed and in which the LED 1 is received, it is ensured to directly attach the LED 1 to the crimp terminal 3. Therefore, the minimization of the illumination unit is surely realized and heat radiation efficiency is surely improved.

According to the above described embodiment, since the depth of the opening 21 is so deep that the LED 1 does not projects from a surface of the housing 2, the impairment of the LED 1 during fastening and clipping the coated wire 6.

According to the above described embodiment, the crimp terminal 3 is provided with the pair of the side plates 42 each of which continues from the attachment portion 40 and the blade 33 which cut in the coating 62 of the coated wire 6 so as to electrically connect to the core wire 61 and is opposite to each other with an interval. Therefore, heat radiation efficiency is further improved since the whole side plates 42 with a large area radiate heat.

According to the above described embodiment, since the crimp terminal 3 is provided with the clip piece 35 for clipping the coated wire 6, an action of unnecessary force on the wire fastener 32 is prevented while the coated wire 6 is pulled. Therefore, for example, since it is not necessary to bend the coated wire 6 as a strain relief and to support the coated wire, the position of the illumination unit 500 relative to the coated wire 6 is easily determined.

Another exemplary embodiment of the present invention is a wire harness including a plurality of illumination units according to the above described embodiment, the illumination units arranged along a longitudinal direction of the wire, wherein the wire is clipped by each of the crimp portions of respective illumination unit.

According to the above described another embodiment, since the wire harness is provided with a plurality of the illumination units, each of the illumination units is arranged along the longitudinal direction of the coated wire, each of the crimp terminals of respective the illumination units fastens the coated wire, it is possible to fasten the coated wire to the crimp terminals without bending the coated wire, and the changes in dimensions of the coated wire due to the bending the coated wire after the attachment of the coated wire to the illumination unit as compare to before the attachment are prevented. Therefore, the distance between each illumination units are precisely controlled.

Below an illumination unit and a wire harness according to a first exemplary embodiment of the present invention is explained with reference to FIGS. 1 to 6.

Figure 5:
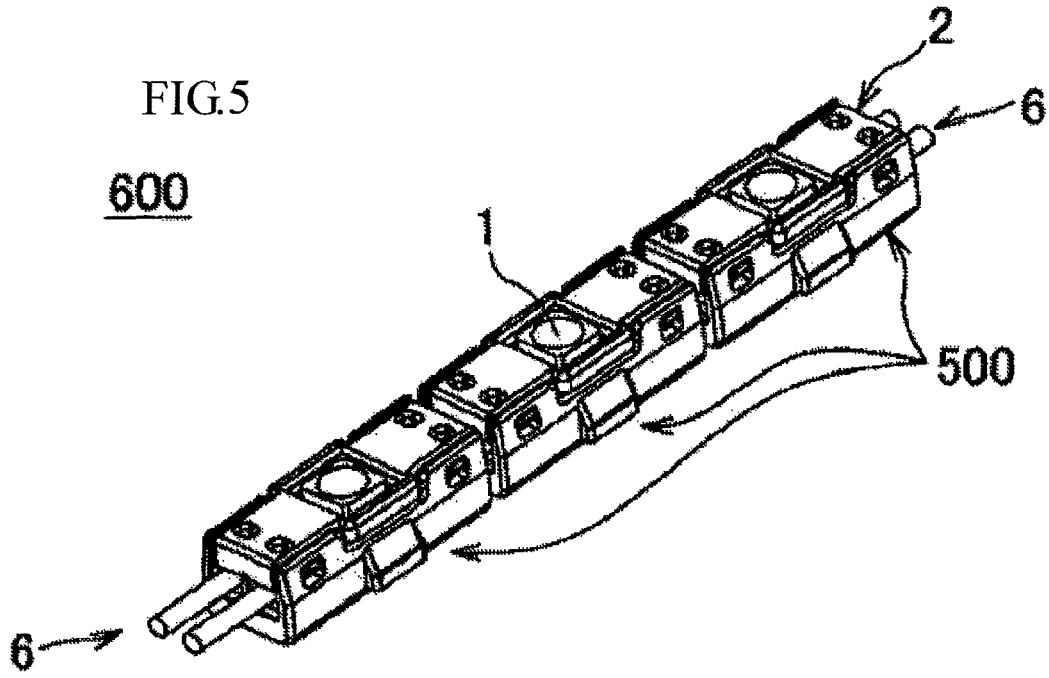
FIG. 5 is a perspective view of a wire harness which is provided with a plurality of the illumination units, each of which is shown in FIG. 1.
Figure 6:
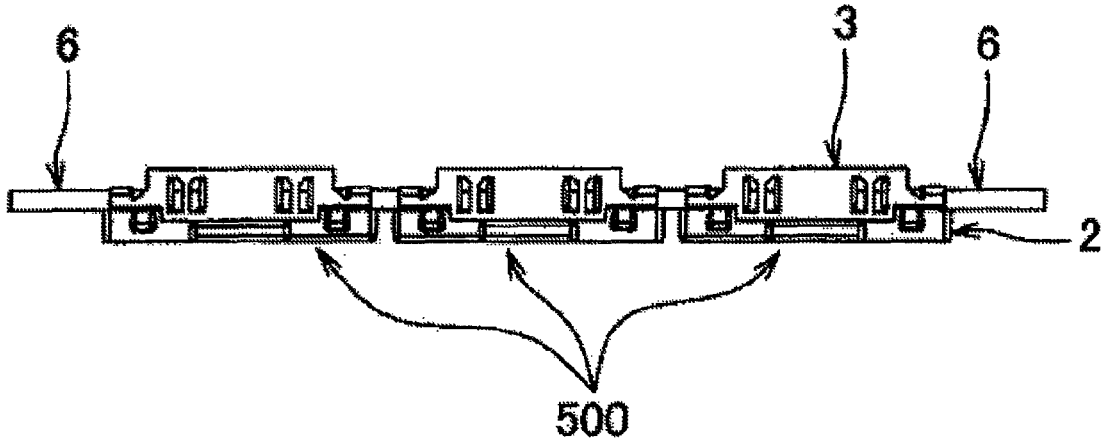
FIG. 6 is a side view of the wire harness shown in FIG. 5 while a wire cover is not attached.
Figure 7:
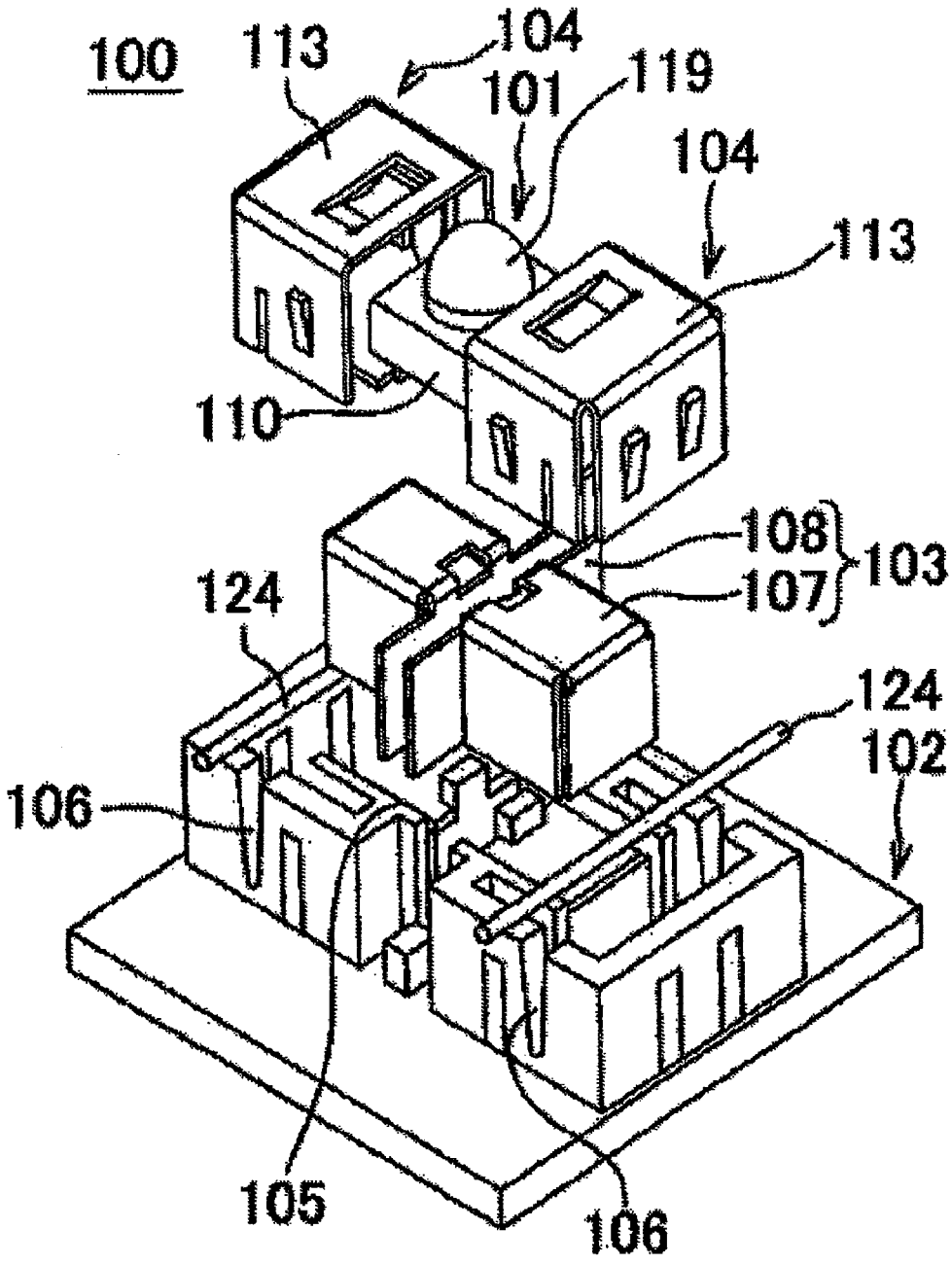
FIG.7 PRIOR ART
FIG. 7 is a perspective view of a related illumination unit.
Figure 8:
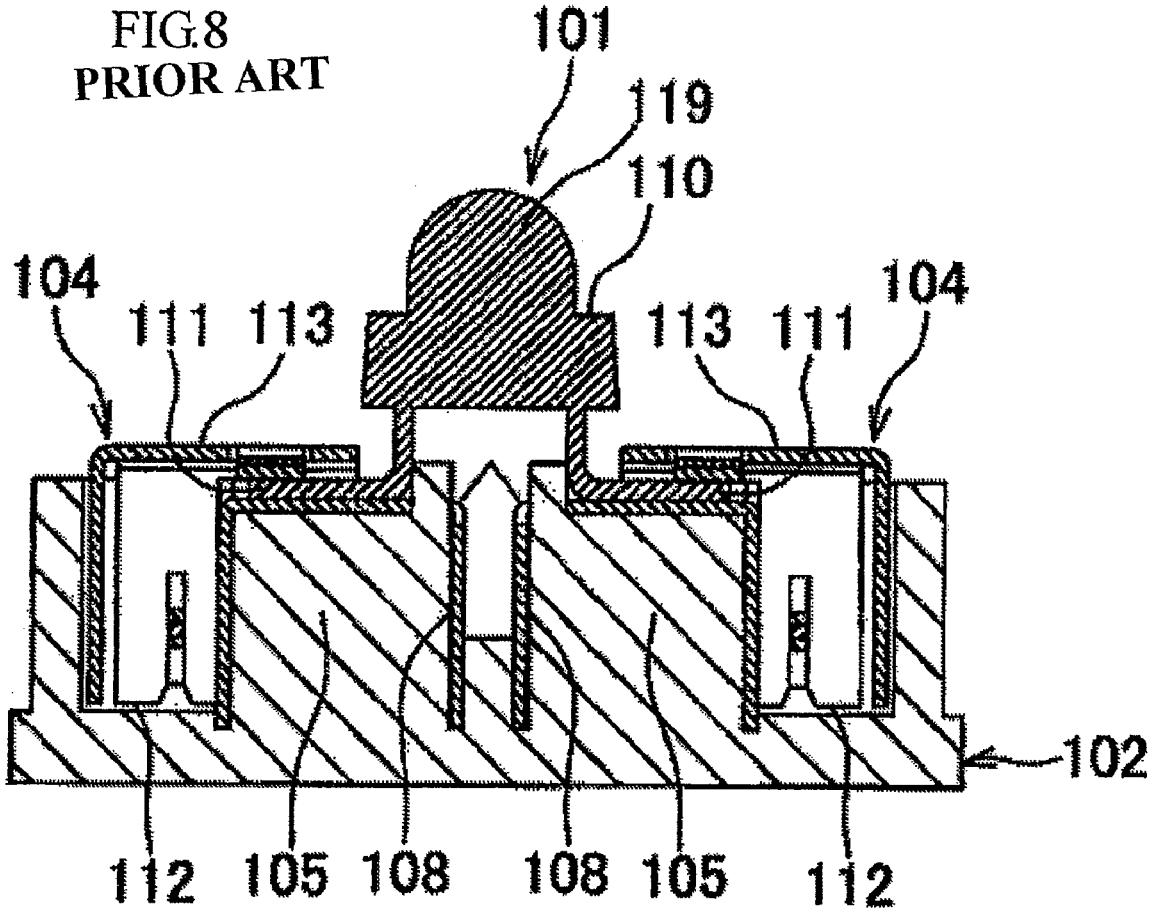
FIG.8 PRIOR ART
FIG. 8 is a sectional view of the related illumination unit.

The wire harness 600 is a wire harness which is attached to an inner surface of the roof panel of a vehicle. As shown in FIGS. 5 and 6, the wire harness 600 is provided with a pair of coated wires 6 and a plurality of illumination units 500. Each of the illumination units 500 is arranged in a longitudinal direction of the coated wire 6 and is provided with a pair of crimp terminals 3 each of which fastens the respective coated wire 6.

The coated wire 6 includes a conductive core wire 61 and an insulative coat 62. The insulative coating 62 is made from a resin and coats the core wire 61 (See FIGS. 2 and 4). Two coated wires 6 are disposed so as to be parallel to each other in a pair.

Figure 1:
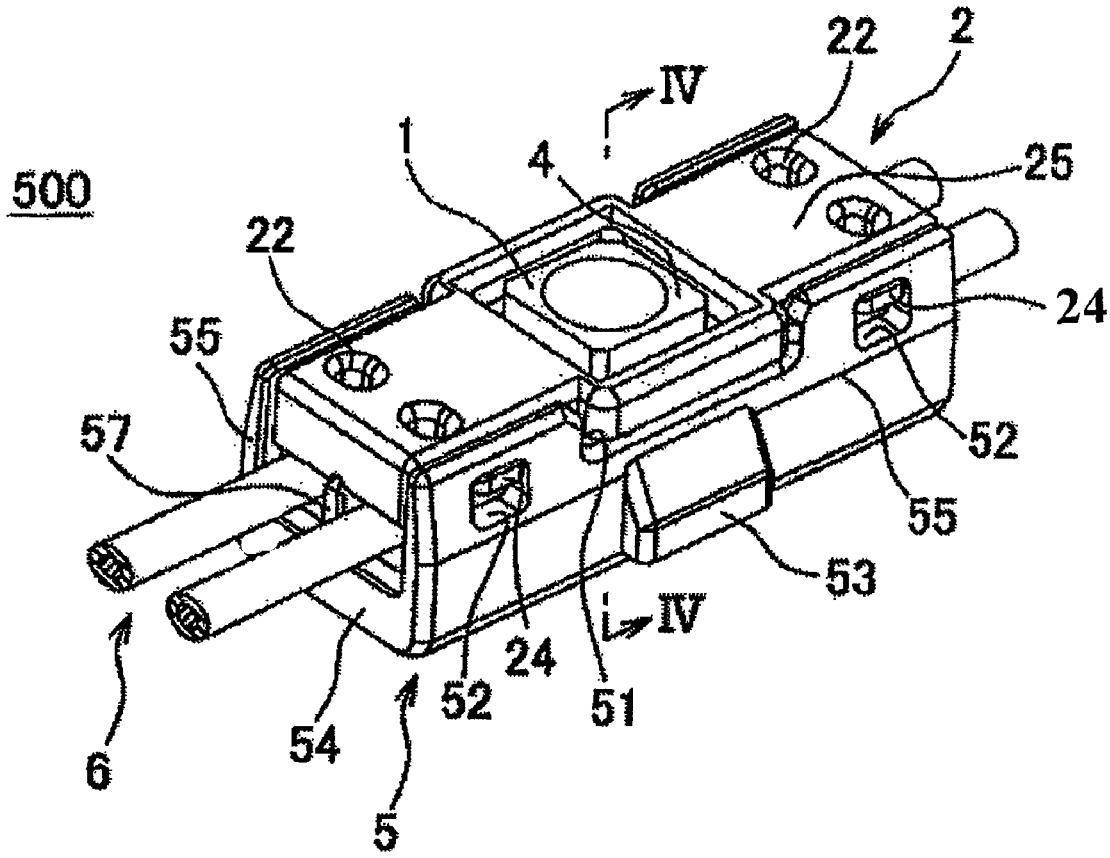
FIG. 1 is a perspective view of an illumination unit according to a first embodiment of the present invention.
Figure 2:
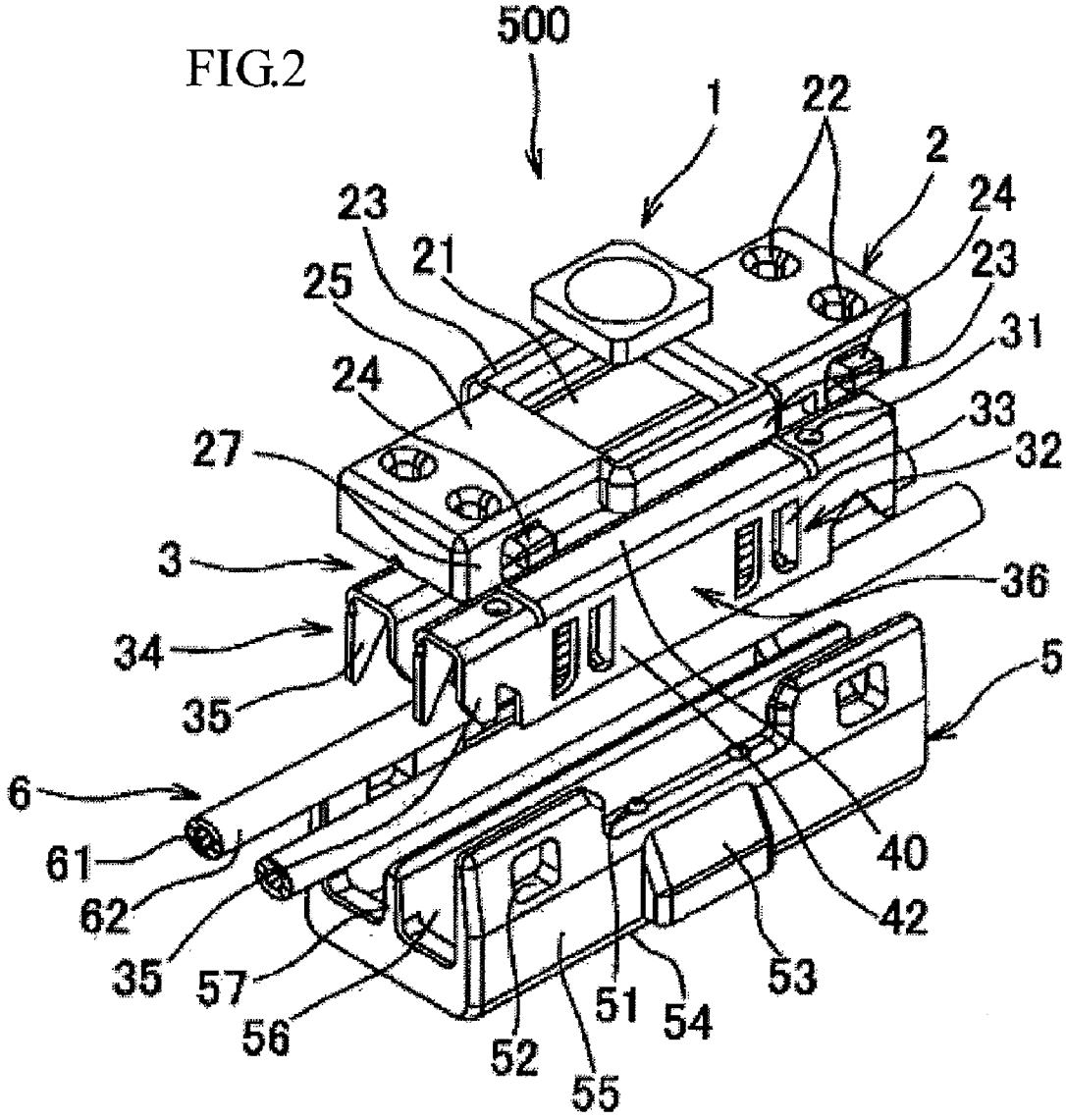
FIG. 2 is an exploded perspective view of the illumination unit shown in FIG. 1.

As shown in FIG. 1, the illumination unit 500 is provided with a surface mounting type LED (hereinafter, LED 1), a housing 2, and the pair of the crimp terminals. Each of the crimp terminals 3 is fixed in the housing 2 so as to be parallel to each other (see FIGS. 2 and 3).

The LED 1 is a so called surface mounting type LED, where a light emitting element is mounted on a front surface of a plate shape base substrate 4. The LED 1 is provided with a pair of plate shape terminals on a rear surface opposite to the front surface where the light emitting element is mounted. (the plate shape terminal is not shown in Figs.)

Figure 3:
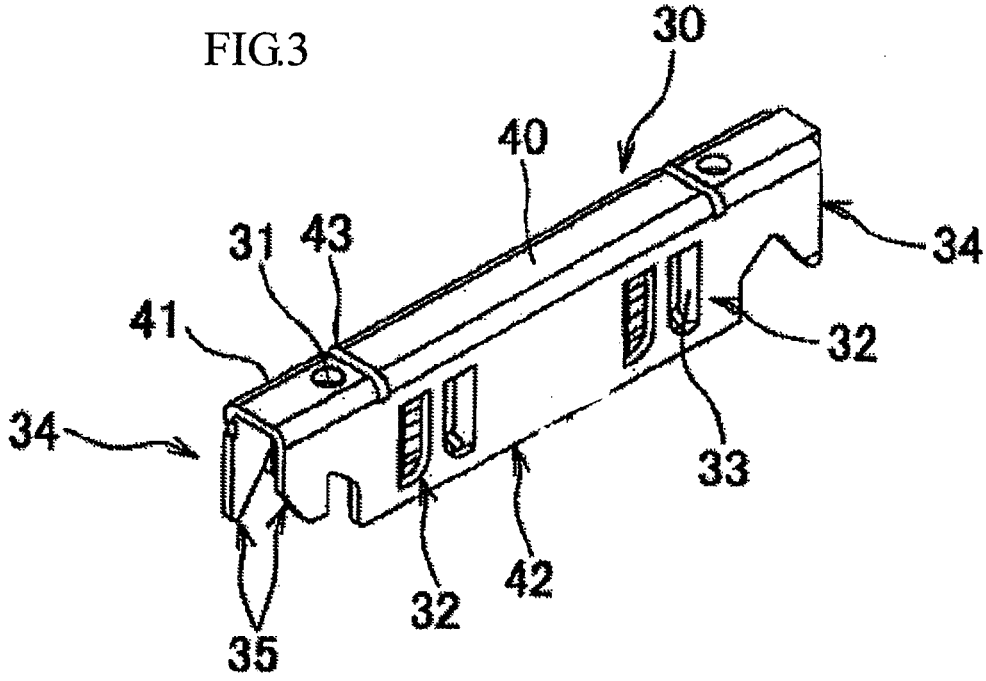
FIG. 3 is a perspective view of a crimp-type terminal provided in the illumination unit shown in FIG. 2
Figure 4:
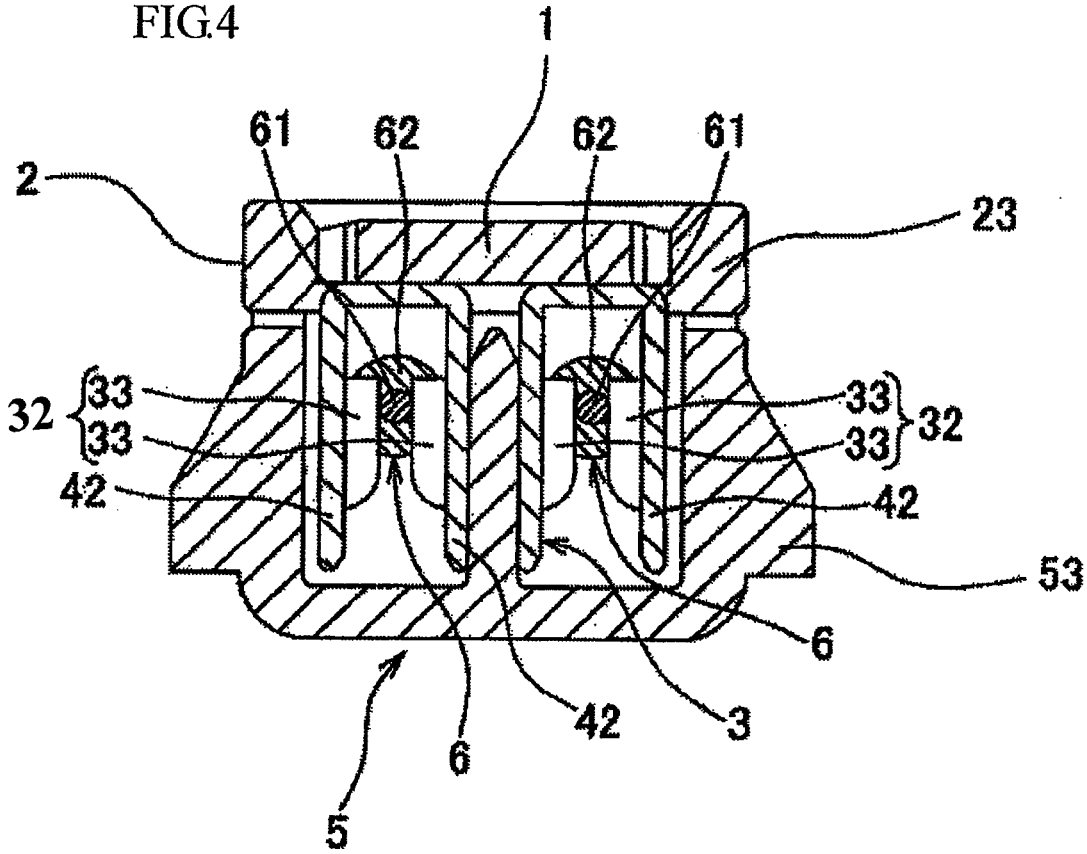
FIG. 4 is a sectional view along IV-IV line in FIG. 1.

The above described crimp terminals 3 are made from a conductive plate or the like. As shown in FIG. 3, each of the crimp terminals 3 has a fastening portion 30 and two crimp portions 34. The two crimp portions 34 continue to the fastening portion 30 at corresponding longitudinal end of the fastening portion 30.

The fastening portion 30 includes a bottom plate 41 which is formed in a plate shape and a pair of side plates 42. Each of the side plates 42 stands from a corresponding longitudinal side of the bottom plate 41 and is opposite to each other. The longitudinal sides of the bottom plate 41 extend along the coated wire 6 and therefore the side plates 42 extend along the coated wire 6. The side plates 42 work as a radiator which radiates heat generated from the LED 1 attached to the bottom plate 41 as described later. Heat radiation efficiency of the side plates 42 is improved since each side plate 42 stands from the respective longitudinal side of the bottom plate 41 so as to ensure a large area of the side plates 42.

The fastening portion 30 includes two wire fasteners 32 which are formed on the fastening portion 30 with an interval in the longitudinal direction thereof. Each of the wire fasteners 32 is provided with two blades 33. Each of the blades 33 is provided on the corresponding side plate 42. In each wire fasteners 32, each blade 33 extends from the corresponding side plate 42 toward the other blade 33. The blade 33 cuts in the coating 62 of the wire which is inserted therebetween, and then electrically contacts to the core wire 61. Thus, the crimp terminal 3 fastens the coated wire 6 respectively.

The bottom plate 41 includes an attachment portion 40 to which the LED 1 is attached, two circular openings 31, and two liner cut-outs 43 which penetrates the bottom plate 41 from the outside to the inside thereof. The attachment portion 40 is positioned at a center portion of a back surface of the bottom plate 41. The back surface of the bottom plate 41 is opposite to a surface of the bottom plate 41on which the wire fasteners 32 are provided. Each opening 31 and each cut-out 43 are provided at the respective longitudinal ends of the bottom plate 41. On each longitudinal end of the bottom plate 41, respective cut-out 43 is positioned inner side than the corresponding opening 31.

The crimp portions 34 continue from the bottom plate 41 and the side plates 42. The crimp portions 34 include two pairs of clip pieces 35 respectively. Each of the pairs of clip pieces 35 is provided at both longitudinal ends of the bottom plate 41. Each of the clip pieces 35 stands from the bottom plate 41 and is opposite to each other with an interval. The coated wire 6 is clipped between the pair of the clip pieces 35 and the bottom plate 41 by bending the clip pieces 35 toward the bottom plate 41. Thus, the clip pieces 35 fix the coated wire 6 on the crimp portion 34 respectively. In this way, the crimp terminal 5 clips the coated wire 6 by the crimp portions 34.

The housing 2 includes an upper cover 25 of a plate shape and a wire cover 5 whose size is almost same as the size of the upper cover 25.

The upper cover 25 is a rectangular plate made from an insulative synthetic resin. The upper cover 25 includes an opening 21 at a center portion of the upper cover 25 in a longitudinal direction thereof, and a pair of opening 22 at both longitudinal ends thereof respectively. The opening 21 has a rectangular shape and a structure which receives the LED 1 therein. As described later, the attachment portion 40 of the crimp terminal 3 is exposed from the opening 21 when the crimp terminal 3 is attached to a rear surface of the upper cover 25. A depth of the opening 21 is deeper than a thickness of the LED 1. Two openings 22 are arranged in a width direction of the upper cover 25 as a pair with an interval. Also, the upper cover 25 includes two projections 23 and a plurality of retaining projections 24. Each of the projections 23 is provided at a longitudinally center portion of the upper cover 25 and outwardly projects in the width direction of the upper cover 25. Each of the retaining projections 24 is provided at a respective longitudinal end portion of the upper cover 25 and outwardly projects in the width direction of the upper cover 25.

The wire cover 5 includes a bottom plate 54, a pair of side plates 55, and a partition plate 57. The bottom plate 54 is thick and has a size same as the upper cover 25. Each of the side plates 55 stands from the respective longitudinal side of the bottom plate 54 and opposite to each other. The partition plate 57 stands from the bottom plate 54 at a position between the pair of side plates 55.The bottom plate 54, the side plates 55, and the partition plate 57 define a pair of chases 56 by which the crimp terminal 3 is received.

Each of the side plates 55 is provided with a recess 51 and a protrusion 53 at the longitudinal center portion thereof. The recess 51 is formed by cutting out an edge of the side plate 55 opposite to the bottom plate 54. The protrusion 53 outwardly protrudes in the width direction of the wire cover 5. Each of the side plates 55 is also provided with two retaining holes 52 at both longitudinal ends of the side plates 55. As described later, once the wire cover 5 is attached to the upper cover 25 in a regular manner, each of the projections 23 engages with the respective recess 51 and each of the retaining projections 24 is inserted into and retained in the respective retaining hole 52.

The above described wire harness 600 is assembled by the following manner. First, the upper cover 25 and the crimp terminal 3 are integrally formed by an insert molding. At this time, each of the openings 22 provided on the upper cover 25 of the housing 2 overlaps the respective opening 31 of the crimp terminal 3. Thus the corresponding pair of the opening 22 and the opening 31 continues so as to penetrate housing 2 and the crimp terminal from the outside to the inside. Second, each terminals of the LED 1 are attached to the attachment portion 40 of the crimp terminal 3 which is exposed from the opening 21 of the housing 2 while each terminal of the LED 1 overlaps the attachment portion 40 by reflow-soldering process. As described above, the LED 1 is received in the opening 21 of the upper cover 25. Then, the crimp terminal 3 and the upper cover 25 to which the LED 1 is attached are arranged along the longitudinal direction of the coated wire 6 with a necessary interval as shown in FIG. 6.

Next, the coated wire 6 is press inserted between the blades 112 of each crimp terminals 3 by a jig. Thus, the crimp terminal fastens the coated wire 6. Also, the coated wire 6 is clipped with the crimp portion 34 by bending the clip piece 35. Thereby, the coated wire 6 is fixed to the crimp terminal 3. Then, each illumination unit 500 is supported by a pair of the coated wire 6 by attaching the wire cover 5 to the upper cover 25. Accordingly, since the crimp terminal 3 is isolated from external parts or the like, a short circuit with the external parts is prevented.

The wire harness 600 assembled in the above described manner provides the LED1 of each illumination unit 5 with electricity through the coated wires 6. The wire harness 600 is attached to the inner surface of the roof panel of a vehicle and used for illuminating the cabin (sheet) of the vehicle.

According to the above described embodiment, since the crimp terminal 3 is provided with the attachment portion 40 to which the LED is directly attached, a member specialized for heat radiation is not necessary, heat generated by the LED 1 is transmitted to and radiated from the crimp terminal 3 with high thermal conductivity, the crimp terminal 3 can be minimized, and heat radiation efficiency can be improved.

Also, since the housing 2 is provided with the opening 21 from which the attachment portion 40 is exposed and in which the LED 1 is received, it is ensured to directly attach the LED 1 to the crimp terminal 3. Therefore, the minimization of the illumination unit is surely realized and heat radiation efficiency is surely improved.

Also since the depth of the opening 21 is so deep that the LED 1 does not projects from a surface of the housing 2, the impairment of the LED 1 during fastening and clipping the coated wire 6 can be prevented.

Also, the crimp terminal 3 is provided with the pair of the side plates 42 each of which continues from the attachment portion 40 and the blade 33 which cut in the coating 62 of the coated wire 6 so as to electrically connect to the core wire 61, and each of the side plates 42 is opposite to each other with an interval. Therefore, heat radiation efficiency is further improved since the whole side plates 42 with a large area radiate heat.

Also, since the crimp terminal 3 is provided with the clip piece 35 for clipping the coated wire 6, an action of unnecessary force on the wire fastener 32 is prevented while the coated wire 6 is pulled. Therefore, for example, since it is not necessary to bend the coated wire 6 as a strain relief and to support the coated wire, the position of the illumination unit 500 relative to the coated wire 6 is easily determined.

In the above embodiment, since the coated wire 6 is fastened and clipped after each of the plurality of the illumination units of a necessary number are arranged on a predetermined coaxial position, the plurality of the illumination units are collectively fixed to the coated wire 6. Thus, the workability for manufacturing is improved.

The present invention is not limited to the above describe embodiment and modifications are possible without departing for the spirit and the scope of the present invention. The materials, forms, dimensions, numbers, style, and disposition are arbitrary if the invention is achieved.

The invention claimed is:

1. An illumination unit comprising:

a first wire and a second wire;

a light emitting element including first and second terminals;

first and second crimp terminals formed of a metal plate and electrically isolated from each other, each of the crimp terminals including an attachment portion to which a respective one of the first and second terminals of the light emitting element is directly attached, a fastening portion which electrically connects to a respective one of the first and second wires, and a crimp portion which clips the respective wire, wherein each crimp terminal is channel shaped, including a top surface corresponding to the attachment portion and a pair of side plates extending downwardly from opposite sides of the top surface and a defining chamber therein extending in a longitudinal direction, parallel to the respective wire, wherein the fastening portion is disposed in the chamber, and wherein the first wires is received in the chamber of the first terminal and the second wire is received in the chamber of the second terminal.

2. The illumination unit according to claim 1 comprising:

a housing in which the crimp terminals are fixed, the housing provided with an opening from which the light emitting element is exposed.

3. The illumination unit according to claim 2, wherein the opening has a depth deeper than a thickness of the light emitting element.

4. The illumination unit according to claim 1, wherein the fastening portion of each of the crimp terminals includes a bottom plate and a pair of side plates, each of the side plates standing from a longitudinal side of the bottom plate and opposite to each other with a predetermined interval.

5. The illumination unit according to claim 4, wherein the side plates and the bottom plate extend along the respective wire.

6. The illumination unit according to claim 5, wherein the wires are coated wires which includes a coating and a core wire coated by the coating.

7. The illumination unit according to claim 6, wherein the each of the side plates is provided with a blade which cut in the coating of the respective coated wire and electrically connects to the core wire.

8. A wire harness comprising:

a plurality of illumination units according to claim 1, the illumination units arranged along the wires, wherein the wires clipped by each of the crimp portions of respective illumination unit.

* * * * *